United States Patent [19]

Malek

[11] Patent Number: 4,805,839

[45] Date of Patent: Feb. 21, 1989

[54] TILT-SPRAY AEROSOL ACTUATOR BUTTON AND DIES

[75] Inventor: Edward J. Malek, Racine, Wis.

[73] Assignee: S. C. Johnson & Son, Inc., Racine, Wis.

[21] Appl. No.: 192,571

[22] Filed: May 11, 1988

[51] Int. Cl.[4] ..... B05B 7/32

[52] U.S. Cl. ..... 239/337; 239/573; 239/579; 239/601; 222/402.1

[58] Field of Search ..... 239/573, 589, 601, 337, 239/579; 222/402.1

[56] References Cited

U.S. PATENT DOCUMENTS

| | | | |
|---|---|---|---|
| 2,887,273 | 3/1959 | Anderson et al. | 239/337 |
| 2,964,248 | 12/1960 | O'Brien et al. | 239/601 |
| 3,008,654 | 11/1961 | Abplanalp et al. | 239/337 |
| 3,083,917 | 4/1963 | Abplanalp et al. | 239/337 |
| 3,083,918 | 4/1963 | Abplanalp et al. | 239/337 |
| 3,269,614 | 8/1966 | Abplanalp | 239/579 |
| 3,464,597 | 9/1969 | Kutik | 239/579 |
| 3,583,642 | 6/1971 | Crowell | 239/337 |
| 3,635,406 | 1/1972 | Scheindel | 239/337 |
| 3,738,541 | 6/1973 | Greenebaum, II | 222/402.1 |
| 3,756,472 | 9/1973 | Vos | 222/189 |
| 3,887,115 | 6/1975 | Petterson | 202/402.13 |
| 4,068,782 | 1/1978 | Van der Heijden | 222/402 B |
| 4,125,226 | 11/1978 | Nieuwkamp | 239/468 |
| 4,583,688 | 4/1986 | Crapser | 239/314 |
| 4,679,713 | 7/1987 | Crapser et al. | 222/402.13 |

FOREIGN PATENT DOCUMENTS

| | | | |
|---|---|---|---|
| 669134 | 11/1929 | France . | |
| 1099584 | 3/1958 | France | 239/573 |

*Primary Examiner*—Andres Kashnikow
*Assistant Examiner*—Chris Trainor

[57] ABSTRACT

Disclosed is an aerosol actuator button for delivering a product such as an atomized air freshener liquid from a pressurized aerosol container wherein the spray pattern produced is tilted away from the central long axis of the actuator button and container. Tilting of the spray pattern is accomplished by placing the actuator button orifice at the bottom of an asymmetrical conical depression which is open to the surrounding atmosphere. More preferably, the orifice itself is asymmetrical with the shorter portion of the orifice being situated relative to the conical depression such that tilting of the spray is accentuated. This configuration causes the atomized spray to be tilted away from the central long axis in spite of the fact that the orifice is concentric with the central long axis of the actuator button. Also disclosed are dies for making such actuator buttons.

4 Claims, 3 Drawing Sheets

TILT-SPRAY AEROSOL ACTUATOR BUTTON AND DIES

BACKGROUND OF THE INVENTION

This invention relates to an actuator button for use on an aerosol spray container to deliver an atomized spray of liquid such as an air freshener and to the dies by which such an actuator button is made.

Aerosol actuator buttons are well known in the art and are used to atomize a pressurized liquid into a spray which can be delivered into a room or to coat an object with the atomized spray. It is desirable to tilt the spray away from the user, but some of the molding techniques required to accomplish such directional control of the spray can be complex. For example, the GLADE ® air freshener sold by S. C. Johnson & Son, Inc. of Racine, Wis. has an overcap wherein the user depresses a top button and the air freshener spray emerges from an orifice which is set at an angle with respect to the central long axis of the can so that the spray is directed upward, but away from the user. The manufacture of such an overcap orifice requires a pin which enters from the side during the molding process and then must be withdrawn before the mold can open. This requires tight tolerances on the mold die.

Other examples of how side directed orifices are manufactured for actuator buttons are described in the Abplanalp et al. U.S. Pat. Nos. 3,008,654; 3,083,917; and 3,083,918. A slightly asymmetrical orifice is created by means of a projection 18 in the '654 patent which is pulled out when the mold pin 17 is retracted after molding the button.

A simpler actuator button used to tilt the spray from an aerosol container is described in U.S. Pat. No. 4,068,782 to Van der Heijden wherein the orifice is co-axial with the valve stem of the aerosol container on which it is placed, but an additional and separate actuator means for tilting the actuator button itself and actuating the release of the spray is required.

U.S. Pat. No. 4,583,688 to Crapser teaches a hose end dispenser where the liquid to be sprayed is released from an orifice 43 which is then carried along by a stream of water onto a mixing platform 40 which is angled so that the spray is tilted in the direction desired.

U.S. Pat. No. 4,679,713 to Crapser et al. shows a valve actuator which sprays straight up, i.e. along the central long axis of the aerosol container, using a hinged button on the side of the overcap.

French Pat. No. 669,134 to Paquelin describes an aerosol atomizer where the orifice is located at the bottom of a conical depression in the side of the sprayer device and is angled directly to the side and slightly up from a line drawn perpendicular to the liquid intake 9.

U.S. Pat. No. 2,887,273 to Anderson et al. shows a spray dispensing assembly having two separate orifices located at the bottom of conical openings 64 and 66 wherein the conical openings are described as "fluid control passages". Conical passage 64 appears to be wider than conical passage 66.

U.S. Pat. No. 3,635,406 to Scheindel shows a one-piece spray head and core pin construction for use on aerosol containers wherein the orifice is located at the bottom of an outer diverging depression. The outer diverging portion of the orifice is said to control, to some extent, the angle of the cone-shaped pattern in which the spray is emitted.

U.S. Pat. No. 3,583,642 to Crowell shows a spray head for an aerosol dispenser in FIGS. 30 through 34 wherein the spray orifice is located at the bottom of an indentation and is off-center with respect to the central long axis of the aerosol can and the valve stem on which it is mounted.

U.S. Pat. No. 3,887,115 to Petterson describes a container-delivery unit for underarm spray products wherein the orifice is mounted to the side of an aerosol spray button device emitting a fan-shaped spray.

U.S. Pat. No. 3,269,614 to Abplanalp shows a dispensing cap for an aerosol container wherein the orifice is set at an angle with respect to the central long axis of the container and the orifice is situated slightly off-center relative to the depression in the cap into which the orifice opens.

U.S. Pat. Nos. 3,756,472 to Vos and 4,125,226 to Nieuwkamp both show atomization nozzles wherein the orifice portion which is open to the atmosphere is surrounded by a curved or conical surface.

There still appears to be a need for an aerosol actuator button which is capable of diverting its spray away from the user without having to utilize complex and highly toleranced dies.

SUMMARY OF THE INVENTION

It is one object of the present invention to provide an aerosol actuator button which directs a spray away from the user, but wherein the orifice is located co-axial with the central long axis of the valve stem of the aerosol container on which the button is mounted.

Another object of the present invention is to provide a means by which the angle at which the aerosol spray emanates from the actuator button can be directed by simply changing the configuration of the area surrounding the orifice where it is exposed to the outside atmosphere and thus avoid having to move the central long axis of the orifice away from the central long axis of the button and valve stem itself.

It is a further object of the present invention to provide an aerosol actuator button having a tilted spray which does not require inserting a die pin which is not co-axial with the central long axis of the button itself.

It is a futher object of the present invention to provide a set of dies for molding tilt spray aerosol actuator buttons which are more compact and simpler to manufacture and use than are dies which require the use of a pin inserted from the side to create an orifice in the button.

It is a further object of the present invention to provide a set of dies for making a tilt spray aerosol actuator button wherein the dies can be withdrawn along the line which is co-axial with the central long axis of the button being molded and thereby permit more buttons to be molded per area of mold plate than is the case when a side pin is used to create an orifice set at an angle with respect to the central long axis of the button.

These and other objects of the present invention are provided by an aerosol actuator button comprising a body having an actuating means for depressing the valve present in the aerosol container and thereby releasing a liquid to be atomized into a cavity in the bottom of the button. The cavity is adapted to sealingly receive the free end of an aerosol valve stem having a hollow bore through which the pressurized liquid passes into an orifice in the top of the button. The orifice is co-axial with the central long axis of the cavity and bore, i.e. with the button. The portion of the orifice facing away from the cavity and open to the outside atmosphere is located at the bottom of an asymmetrical conical depression in the top of the button. The asymmetrical configuration of the conical depression causes the liquid escaping from the orifice to be tilted away from the central long axis of the actuator button and the central long axis of the resulting aerosol spray pattern is likewise tilted away from that central long axis.

In a more preferred embodiment, the orifice itself has an asymmetric configuration wherein one portion of the orifice is generally shorter in length than the other portion. The conical depression is situated relative to the shorter portion of the orifice so as to enhance the tilting of the resulting spray pattern in the direction of the shorter portion of the orifice and thus away from the user.

Asymmetric positioning of the orifice at the narrowest part of the conical depression is important since the spray pattern tends to follow the sides of the conical depression. The spray pattern tends to angle or tilt toward the portions of the cone which deviate the greatest from the central long axis on which the orifice is centered.

BRIEF DESCRIPTION OF THE DRAWINGS

The above and other objects and features and advantages of the present invention will become apparent to those skilled in the art upon examination of the following description of the present invention.

In the drawings.

DETAILED DESCRIPTION OF THE INVENTION

Figure 1:
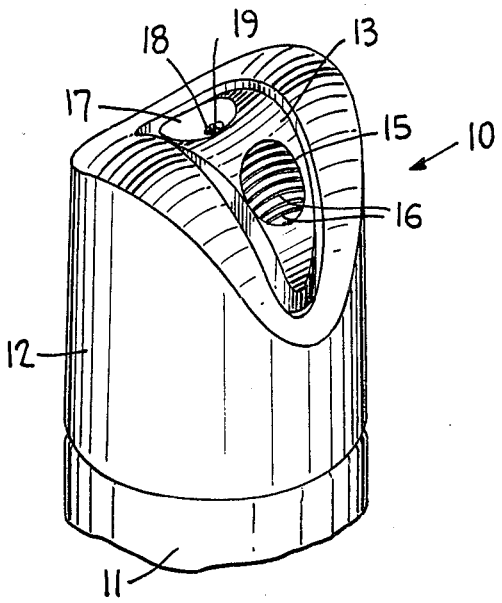
FIG. 1 is a perspective view of an overcap embodying the present invention taken from the top rear showing a portion of the aerosol container on which it is mounted.
Figure 2:
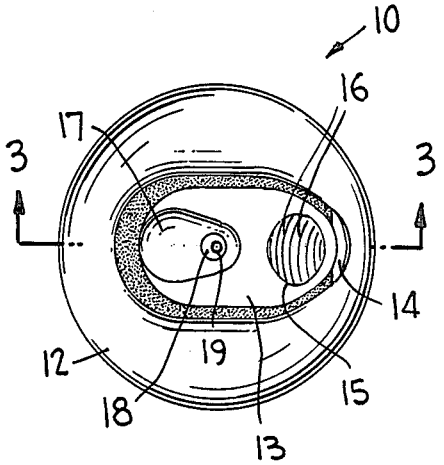
FIG. 2 is a plan view of FIG. 1.

Referring to the drawings, FIGS. 1 and 2 show one embodiment of the tilt spray aerosol actuator button of the present invention. Plastic overcap 10 is shown fixed on a conventional pressurized aerosol container 11 (partially shown). Overcap 10 is composed of plastic outer shell 12 and tilt-spray aerosol actuator button 13 which is joined to outer shell 12 by means of a plastic hinging strip 14. Button 13 contains an actuating means in the form of a depressed finger pad 15 having a number of raised ridges 16. Button 13 also contains concavity 17 further containing conical depression 18 which is open to the atmosphere and orifice 19 located at the bottom, i.e., the narrowest portion, of asymmetrical conical depression 18.

Figure 3:
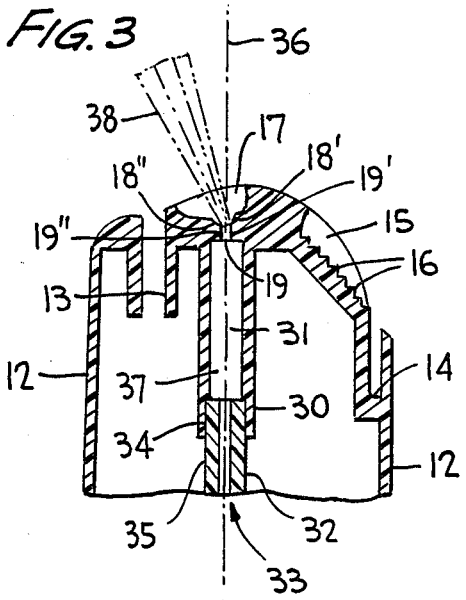
FIG. 3 is a cross-sectional view of the overcap and a portion of the valve stem from the container of FIG. 2, taken along section lines 3—3.

FIG. 3 illustrates what occurs when a user presses on finger pad 15 in the direction of container 11. Orifice 19 on button 13 contains tubular extension 30 having cavity 31 running through the middle of extension 30 which is in flow communication with orifice 19. At its lower end, cavity 31 has a wider portion 34 which sealingly engages the outside 35 of conventional tubular valve stem 32. Valve stem 32 has a central hollow bore which is in flow communication with cavity 31 and the pressurized liquid 37 from container 11. Orifice 19, cavity 31, and bore 33 are all co-axial with the central long axis 36 of button 13.

In the preferred embodiment shown, conical depression 18 is asymmetric since wall 18" is more severely angled relative to axis 36 than is wall 18'. The result can be seen in FIG. 2 wherein the portion of depression 18 containing wall 18" is wider than that containing wall 18'. In the preferred embodiment shown, the portion of orifice 19 indicated at numeral 19' is longer than the portion indicated at numeral 19". Thus the orifice opening is asymmetric and angles down from the top of portion 19' to portion 19". Portion 19" is coupled with the longer or more severely angled 18" portion of the cone to tilt spray 38 which results when pressurized liquid 37 is forced through orifice 19 in a direction away from axis 36 and finger pad 15, i.e., the user. In a less preferred embodiment, portions 19' and 19" can be the same length.

Thus, pressurized liquid passes through hollow bore 33 when finger pad 15 is depressed and travels under pressure through cavity 31 and through orifice 19 where it contacts the atmosphere in conical depression 18 and is tilted away from axis 36 as a result of the configuration of conical depression 18 and the asymmetric configuration of orifice 19.

Figure 4:
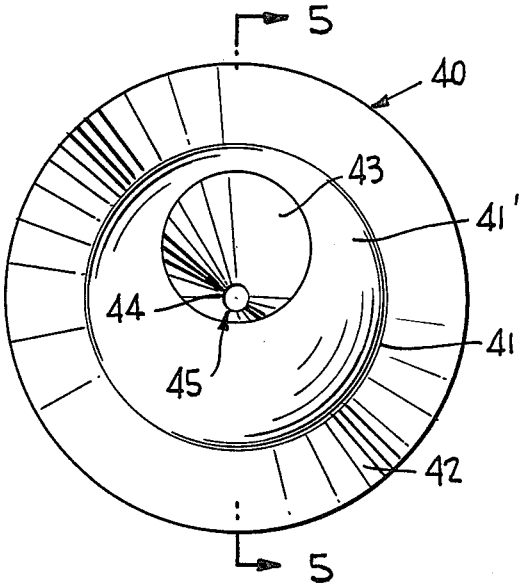
FIG. 4 is a plan view of an alternative embodiment of the aerosol actuator button of present invention.
Figure 5:
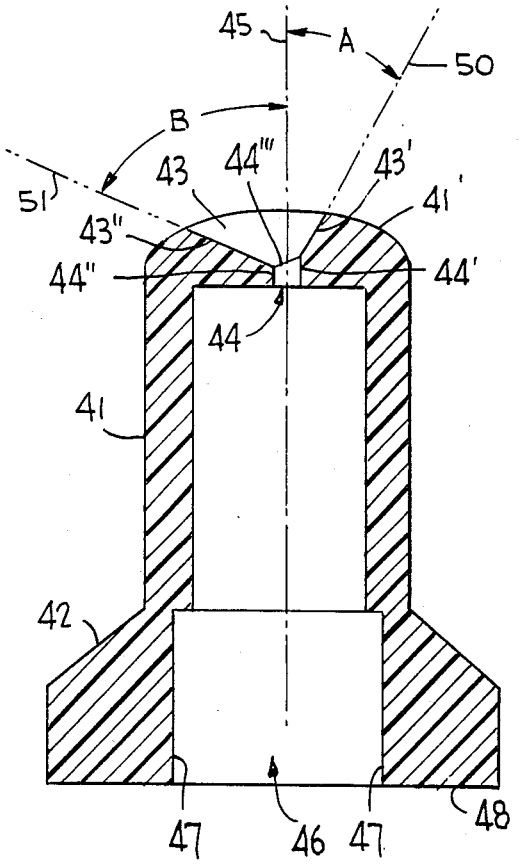
FIG. 5 is a cross-sectional view of FIG. 4, taken along section lines 5—5.
Figure 6:
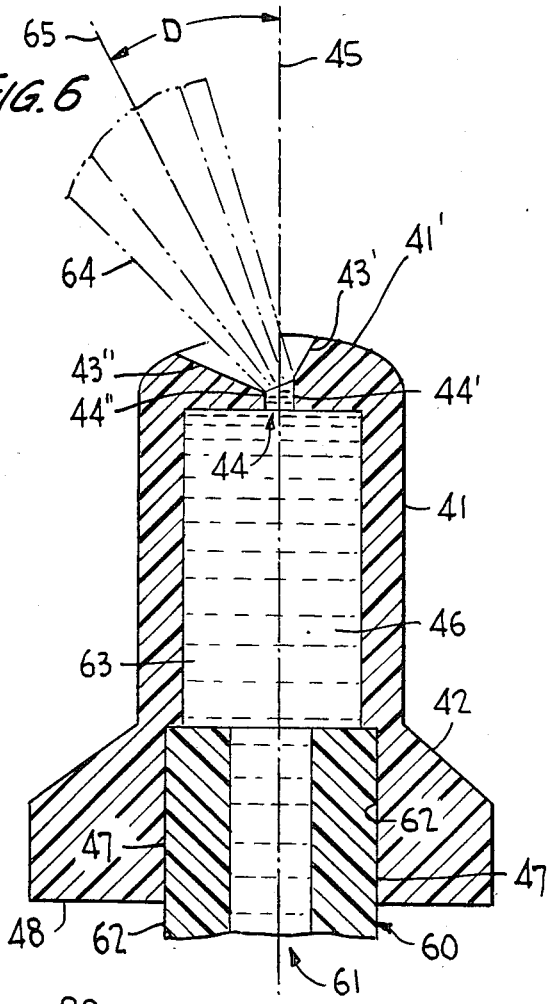
FIG. 6 is a cross-sectional view of FIG. 4, taken along section lines 5—5, further showing the presence of a liquid being atomized and the manner in which a valve stem fits within the aerosol actuator button shown.

FIGS. 4 through 6 show a more simplified embodiment of the aerosol actuator button of the present invention. FIG. 4 shows aerosol actuator button 40 composed of an elongated portion 41 and an actuating means in the form of collar 42. Elongated portion 41 contains a convex upper surface 41' exposed to the atmosphere which contains asymmetrical conical depression 43 at the bottom of which is orifice 44 which is concentric with central long axis 45.

FIGS. 5 and 6 show cavity 46 present within button 40 wherein cavity 46 is concentric with axis 45 and has a wider portion 47 therein for sealing engagement with the outside portion 62 of a conventional tubular aerosol container valve stem 60.

Orifice 44 is also concentric or co-axial with axis 45. Orifice 44 is asymmetric as can be seen by viewing FIG. 5 wherein portion 44' is shown as being greater in height than portion 44". As shown by line 44'", orifice 44 is asymmetrical with portion 44' being the longest and 44" being the shortest portion of the orifice. Without wishing to be bound by theory, it appears that pressurized liquid leaving surface portion 44" and entering the atmosphere within depression 43 begins to atomize before liquid released alongside portion 44'. This is believed to accentuate the tilting of the spray pattern 64 in the direction of portion 44' and away from axis 45. As noted earlier, portions 44' and 44" could be the same in height so that orifice 44 is symmetrical.

Lines 50 and 51 in FIG. 5 show the angle as angle "A" and angle "B" formed by walls 43' and 43" with respect with axis 45. To accomplish the tilting of spray pattern 64 whose central long axis is indicated as line 65 in FIG. 6, angle A should be less than angle B. Preferably, angle A is between 10 and 20 degrees with respect to axis 45 and angle B is preferably between 70 and 80 degrees with respect to axis 45. Without wishing to be bound by theory, it is believed that a partial vacuum is created between the surfaces of conical depression 43 and the emerging spray pattern 64. The amount of vacuum created in the area at wall 43'' is different from that created in the area at wall 43' and thus the spray pattern 64 tilts away from axis 45 to the extent shown in FIG. 6 as angle "D", the angle between axis 45 and the central long axis of spray 65 of spray pattern 64. Alternatively, more air is mixed with the liquid escaping from orifice 44 at wall 43'' than is mixed initially at wall 43'. As a result, the central long axis 65 of spray pattern 64 is tilted away from axis 45 at angle D as shown in FIG. 6. A decided tilt in the aerosol spray pattern was observed when tilt spray actuator buttons of the present invention were used.

By selecting an appropriate combination of angles A and B, spray pattern 64 can be tilted to a preselected angle D. The angle D obtained is dependent upon the nature of the pressurized liquid to be delivered. The non-volatile solids content, percentage of solvent and aerosol propellant, and nature of the solvent, and other factors may affect the actual angle D observed for a specific composition. Generally, a configuration is selected having specific angles A and B and the composition is sprayed through the orifice to determine angle D. Adjustments in angles A and B can then be made to obtain the desired angle D. It is also to be understood that orifice 44 is asymmetrical and portion 44' is generally the highest portion of the orifice and portion 44'' is the shortest portion with the remainder of the orifice being asymmetric as shown by line 44'''. As with respect to the button of FIGS. 1 through 3, portions 44' and 44'' can be of equal height so that orifice 44 is symmetrical. Collar 42 is depressed to actuate the flow of pressurized liquid through orifice 44 from an aerosol container. The button 40 shown in FIGS. 4 through 6 could be used as a valve actuator, with appropriate modification, for the device described In U.S. Pat. No. 4,679,713 to Crapser et al., noted above.

Turning to FIGS. 7 through 10, the dies and manner of making a tilt-spray actuator button of the present invention, specifically the one described in FIGS. 4 through 6, will now be discussed.

Figure 7:
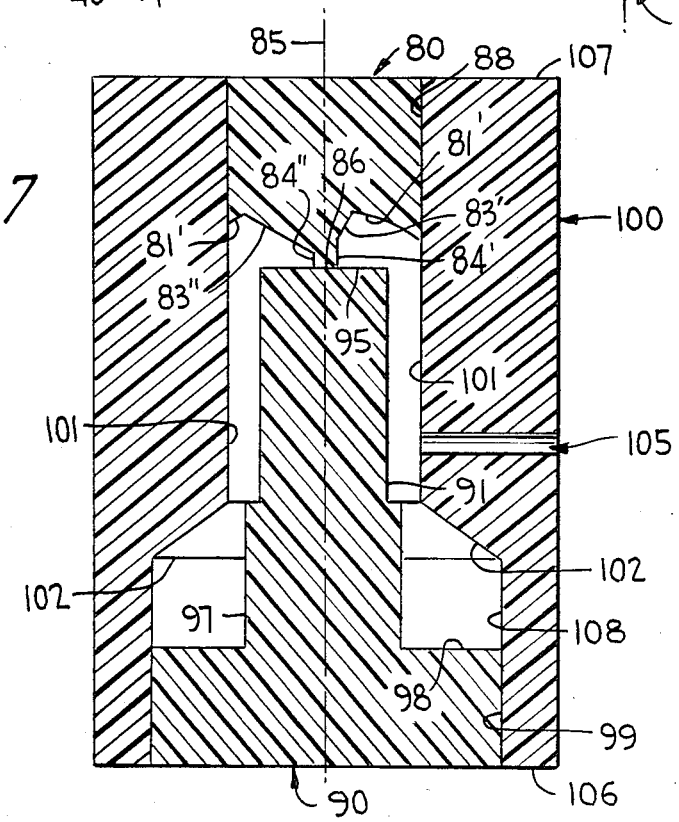
FIG. 7 is a cross-sectional view of the dies used to manufacture the button shown in FIGS. 4–6.
Figure 8:
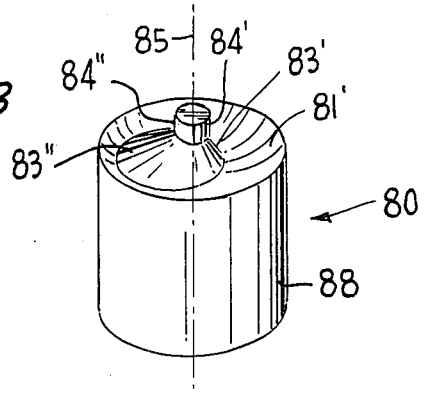
FIG. 8 shows the male die used to mold the orifice.
Figure 9:
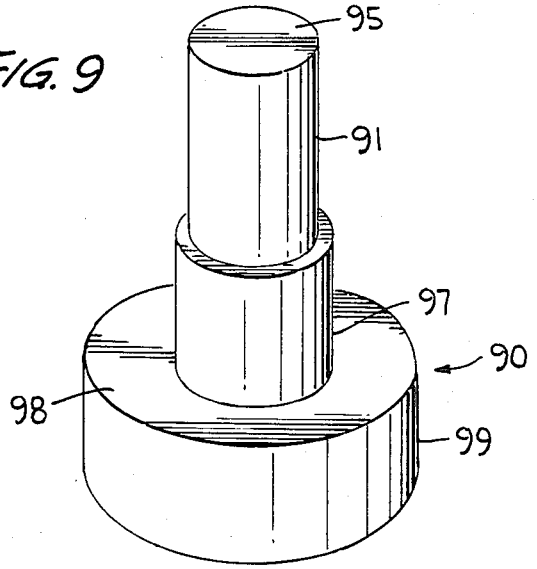
FIG. 9 shows the male die used to mold the inside of the button of FIGS. 4–6.

FIG. 7 depicts an assembled mold composed of male dies 80 and 90 which are inserted within female die 100 in the manner shown. The mold plate structure holding the dies together in the alignment shown is conventional and has been omitted for purposes of clarity. Referring to male tool 80, surfaces 81', 83', 83'', 84' and 84'' form surface 41', 43', 43'', 44' and 44'', respectively, of button 40. Face 85 which has the same area, configuration and diameter as orifice 44 is concentric with central long axis 85 of die 80. Similarly, face 95 of die 90 is likewise concentric with axis 85 when the dies are assembled in female die 100. Outside 88 of die 80 fits closely within the inside surface 101 of tool 100. Surfaces 85 and 95 of dies 80 and 90, respectively, touch as is shown in FIG. 7 when the dies are placed together.

Surface 91 of die 90 forms the upper portion of cavity 46 while surface 97 forms surface 47 of cavity of 46. Surface 99 closely fits against surface 108 of die 100 and surface 98 forms bottom surface 48 of button 40.

Figure 10:
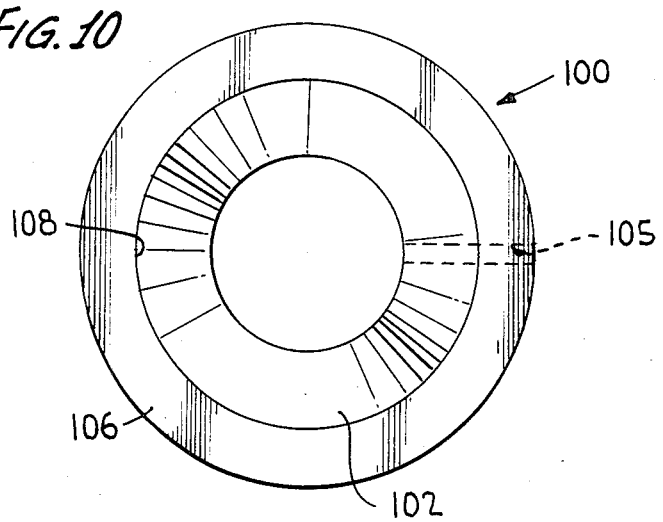
FIG. 10 shows the female die in which the male dies of FIGS. 8–9 are inserted.

Referring to FIGS. 7 and 10, female die 100 is shown having a molten plastic inlet 105 for use in charging the mold with plastic material. Any of the commonly used plastic materials for aerosol buttons and overcaps such as high density polyethylene as well as polypropylene can be employed. The dies can be made of conventional metals used in molding dies such as H13 and S7 type steels, oil-hardened tool steels, air-hardened tool steels, aluminum and the like. The material from which the buttons and dies are made forms no part of the present invention. Bottom surface 106 is shown in FIG. 10 and the bottom of die 90 is held flush with surface 106 while the bottom surface of die 80 is held flush with the top surface 107 of die 100 when the mold is used to produce actuator buttons.

One advantage of the present invention is that die 80 can be withdrawn from die 90 to release the molded actuator button along axis 85 and no side pins need be removed since the orifice 44 is concentric with axis 85 (axis 45 of the button 40). As a result, the dies are more compact and take up less surface area within a molding plate. More of this type of die can be placed in a given area of molding plate. For example, instead of being limited to sixteen cavities per mold plate, a device of the present invention could employ twenty-four in the same mold plate. This is a substantial savings in cost and since no pin is being used to create a side spraying orifice. Thus, mold down-time due to repair or clogging of parts is minimized. Since the need for a pin to slide within another mold part to create a side spraying orifice has been eliminated, the tolerancing between those two parts is eliminated by the dies of the present invention. Male die 80 thus forms the orifice for the tilt spray actuator button of the present invention in one operation.

It will be readily apparent to those skilled in the art that dies 80 and 100 could be combined together, for example, where surfaces 88 and 101 meet to form its single female tool into which die 90 is inserted.

Actuator buttons of the present invention can therefore be used in any application where a tilt spray pattern is desired, such as in air freshener delivery containers, carpet and other fabric care applications, and insecticide or germicide dispensing in the form of aerosol sprays. Other modifications and variations of the buttons and dies of the present invention will become apparent to those skilled in the art from the examination of the above specification and drawings. Thus, other variations of the tilt spray actuator button and dies for making the same may be made which fall within the scope of the appended claims, even though such variations were not specifically discussed above.

That which is claimed:

1. An aerosol actuator button comprising a body having a top and a bottom portion and a cavity located in the bottom thereof adapted to sealingly receive the free end of an aerosol valve stem having a hollow bore which is in flow communication with an orifice in the top portion of said body for releasing a pressurized liquid to be atomized, said cavity and said bore having a central long axis said orifice having an inlet and an outlet coaxial with the central long axis of said cavity and bore, said orifice outlet being located at the bottom of an asymmetrical conical depression in said button which is open to the atmosphere wherein the conical depression is configured to cause the liquid escaping from the orifice to be tilted away from the central long axis of the cavity as it is atomized into an aerosol spray pattern also having a central long axis, and wherein the central long axis of said aerosol spray pattern is tilted away from the central long axis of said cavity at a preselected angle.

2. The aerosol actuator button as claimed in claim 1 wherein the orifice outlet includes portions of varying heights which define an asymmetrical configuration wherein one portion of the orifice is shorter in length than the other portion and the conical depression is situated relative to the shorter portion of the orifice so as to enhance the tilting of the resulting spray pattern in the direction of the shorter portion of the orifice.

3. The aerosol actuator button of claim 1 wherein the conical depression has an inner conical surface having a varying degree of slope angularly deviating from that of the central long axis, wherein the greatest deviation of the conical depression from the central long axis of the cavity is between about 10 and 20 degrees and the smallest deviation from the central long axis of the cavity is between about 70 and 80 degrees.

4. The aerosol actuator button of claim 2 wherein the greatest deviation of the conical depression from the central long axis of the cavity is between about 10 and 20 degrees and the smallest deviation from the central long axis of the cavity is between about 70 and 80 degrees.

* * * * *

UNITED STATES PATENT AND TRADEMARK OFFICE

CERTIFICATE OF CORRECTION

PATENT NO. : 4,805,839

DATED : February 21, 1989

INVENTOR(S) : Edward J. Malek

It is certified that error appears in the above-identified patent and that said Letters Patent is hereby corrected as shown below:

In Column 8, Line 8, after the words "claim 2", the following should be inserted --wherein the conical depression has an inner conical surface having a varying degree of slope angularly deviating from that of the central long axis,--.

Signed and Sealed this

Fifteenth Day of January, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,805,839

DATED : February 21, 1989

INVENTOR(S) : Edward J. Malek

It is certified that error appears in the above-identified patent and that said Letters Patent is hereby corrected as shown below:

In Column 8, Line 7, after the words "claim 2", the following should be inserted --wherein the conical depression has an inner conical surface having a varying degree of slope angularly deviating from that of the central long axis,--.

Signed and Sealed this

Twelfth Day of February, 1991

*Attest:*

HARRY F. MANBECK, JR.

*Attesting Officer*

*Commissioner of Patents and Trademarks*